US006230622B1

(12) United States Patent
Dilling

(10) Patent No.: US 6,230,622 B1
(45) Date of Patent: May 15, 2001

(54) IMAGE DATA-ORIENTED PRINTING MACHINE AND METHOD OF OPERATING THE SAME

(75) Inventor: Peer Dilling, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/315,553

(22) Filed: May 20, 1999

(30) Foreign Application Priority Data

May 20, 1998 (DE) ..... 198 22 662

(51) Int. Cl.[7] ..... B41F 13/00

(52) U.S. Cl. ..... 101/484; 101/349.1; 101/483

(58) Field of Search ..... 101/211, 216, 101/219, 349.1, 350.1, 483, 484, 365

(56) References Cited

U.S. PATENT DOCUMENTS

| | | | | |
|---|---|---|---|---|
| 4,829,898 | * | 5/1989 | Wieland | 101/483 |
| 5,111,744 | * | 5/1992 | Wieland | 101/216 |
| 5,119,727 | * | 6/1992 | Miyamoto et al. | 101/352 |
| 5,224,421 | * | 7/1993 | Doherty | 101/211 |
| 5,333,069 | * | 7/1994 | Spence | 358/517 |
| 5,406,884 | * | 4/1995 | Okuda et al. | 101/137 |
| 5,493,321 | * | 2/1996 | Zwadlo | 347/131 |
| 5,570,633 | * | 11/1996 | Schultz et al. | 101/182 |
| 5,588,366 | * | 12/1996 | Loffler | 101/484 |
| 5,652,831 | * | 7/1997 | Huang et al. | 395/131 |
| 5,709,148 | * | 1/1998 | Uera et al. | 101/350 |
| 5,721,789 | * | 2/1998 | Loffler | 101/483 |
| 5,927,201 | * | 7/1999 | Birkenfeld et al. | 101/365 |
| 5,953,498 | * | 9/1999 | Samworth | 395/109 |
| 5,967,049 | * | 2/2000 | Seymour et al. | 101/484 |
| 6,024,018 | * | 2/2000 | Darel et al. | 101/365 |

FOREIGN PATENT DOCUMENTS

| | | | |
|---|---|---|---|
| 43 28 026 A1 | 3/1995 | (DE) | B41F/33/16 |
| 196 27 459 A1 | 1/1998 | (DE) | B41F/33/00 |
| 197 31 003 A1 | 1/1999 | (DE) | B41F/31/04 |
| 0 495 563 A2 | 7/1992 | (EP) | H04N/1/40 |
| 4-221642 | 8/1992 | (JP) | B41F/31/02 |
| 5-57879 | 3/1993 | (JP) | B41F/33/00 |
| 7-76069 | 3/1995 | (JP) | B41F/33/00 |
| 7-164619 | 6/1995 | (JP) | B41F/33/10 |
| WO 96/06737 | 3/1996 | (WO) . | |

OTHER PUBLICATIONS

Article entitled "Expertensysteme" by Ulrich Schmitt published in Druckwelt 5 dated Mar. 10, 1993, pp28–31 No Translation.

Schneider, Josef O., "*L'Integration Dans LaChaine Graphique*" ppresented at the *Colloque Caractere* (Character Conference) in Paris on Nov. 14–15, 1990 No Translation.

* cited by examiner

*Primary Examiner*—Daniel J. Colilla
(74) *Attorney, Agent, or Firm*—Cohen, Pontani, Lieberman & Pavane

(57) ABSTRACT

A method of operating a printing machine and a printing machine apparatus in which basic knowledge about the interaction between operating media in the printing machine is obtained through printing trials or during production. This knowledge is stored in an expert system and made available for the printing operation or else for the production of the printing plate. The expert system is preferably a self-teaching system. For color reproduction, basic calibrations are carried out in a first quality step, in a second step, the imaging operation is adapted to the areas and half tones to be imaged, and ink-density regulation is carried out in a third step.

24 Claims, 10 Drawing Sheets

FIG. 8

| ACTUATING OPTIONS | | STATIC | LOW TO HIGH-FREQUENCY |
|---|---|---|---|
| EQUAL OVER CYLINDER WIDTH | | BASIC CALIBRATION IMAGING | DOCTOR BLANKET CYLINDER SETTING |
| INCLINED OVER CYLINDER WIDTH | | IMAGING | DOCTOR |
| NON-LINEAR OVER PAGE WIDTH | | IMAGING | ------ |
| CIRCUMFERENTIAL | | IMAGING | DOCTOR |
| SUBJECT-DEPENDENT, LOCAL | | IMAGING | ------ |

IMAGE DATA-ORIENTED PRINTING MACHINE AND METHOD OF OPERATING THE SAME

BACKGROUND OF THE INVENTION

1. Field of the Invention

The invention relates to printing machines, and more particularly to an image data-oriented printing machine.

2. Description of the Related Art

Observations are already known which relate to preparing the data used for the printing process such that the printing process is optimized. Attempts have been made to make the observed information useful to the printing process. In this case, for example, the intention is for the preparation of the printing image information for the production of the printing plate to be performed in a manner optimized to the printing machine in the process referred to as the pre-press stage. This process, by its nature, is dependent on the availability of information relating to what is to be done later with the image data in the printing machine. Using this information, the printing process can compensate for the changes to the information which are specific to the printing machine in order to achieve good results. This requires communication between the pre-press stage and printing machine. This data interchange is generally achieved by means of so-called print-run standards, which predefine a bandwidth within which a printing machine varies the image data to be printed when specific ink and paper classes are being used. The properties of the pre-press stage and of the printing machine determine the achievable bandwidth. Naturally, it is also possible for special standards to be predefined externally by the printer and, for example in package printing, for these standards to define other transfer characteristic curves which are specifically suitable for this. However, these particular characteristic curves can intrinsically apply only within the very limited range of action in accordance with the defined printing material. In order to improve the print quality in the sense of better agreement with the predefinition and with more highly constant printing results, it is expedient to allow information relating to the product to be printed to influence the quality management system. These days, this information is provided almost exclusively by the printer who operates the machine, with the assistance of special sensors, such as an electronic plate scanner.

Although the product information is present at the pre-press stage, it is to some extent varied when it is output to the printed image carrier (printing plate or printing material). However, the printing machine control system would be able to operate better with the respective product information from the pre-press stage if these variations were known.

It transpires that it is expedient to obtain information for the printing machine control system in general terms from the data which is present at the pre-press stage. For this purpose, these variations would also have to be known at the pre-press stage. The paper "L'intégration dans la chaîne graphique" (Integration in the graphic chain), presented by J. Schneider at the "Collogue Caractère" (Character conference), 14/15.11.1990, Paris, has already disclosed the practice of feeding image data values which are used to set up the printing plate to the central control station of the printing machine. They can thus be used, for example, for pre-setting the inking zones. EP 0 495 563 A2 proposes using an integrated, computer-controlled system as a control system for a number of stages in a printing process. The information to be applied to the printing plate is present in digital form (digital pre-press) and from this layout information is used to produce, for example, pre-setting data (ink feed) for the printing machine and desired values for the ink feed in order to achieve an envisaged printing characteristic curve.

DE 43 28 026 A1 discloses a communication method in a communication system with computer-controlled data transmission for the purpose of controlling the printing process of a printing machine. This method has been optimized to the effect that, for areas of the printing process which operate upstream of the printing machine, no special adaptation has to be undertaken when different printing machines are used, and that the printing machine is able to receive data relating to the pre-setting and process control without the machine having to know the type of the independently operating area. In this communication method, a communication structure is used for interlinking areas of the printing process which operate on a digital basis and independently of the printing machine, especially areas of a pre-press stage. The communication structure permits the entire printing plate to be imaged, and permits an interchange of data between the various independently operating areas and the printing machine on the basis of which data requests in both directions can be attended to in a manner which is not type-specific. Data for regulating the printing machine is obtained from data which is independent of machine type, and in particular from the pre-press stage. This data can be used by the pre-press stage of the printing machine to influence the data to be printed.

On the other hand, DE 196 27 459 A1 discloses a printing machine in which measured color values are determined with the aid of an image recording device at a large number of measurement locations trailing the printing image. The color valves are transformed into color loci in a defined color space. The distribution of the color loci in the color space is determined, and from this distribution, signals are derived which contain the color loci of the printing ink (CMKY) which was probably used. The derived color loci of the printing inks (CMKY) probably used are in each case compared with the color loci which the operator has preselected. If a color offset resulting from the comparison exceeds a predefined amount, a signal is generated, and a display is activated which contains information for the operator relating to the fact that the laws he has selected probably do not correspond to the printing inks (CMKY) used.

SUMMARY OF THE INVENTION

In a method, of the type mentioned previously, (i.e., of operating a printing machine controlled by image data), it is the object of the invention to adapt the printing operation at each printing point automatically to the required color locus.

Likewise, another object of the invention is to provide a printing machine which is suitable for such a printing method.

In the image data-oriented printing machine of the invention, data relating to quality assurance in the print is used predictively as early as in the digital path as possible and expediently by means of digital imaging. A precondition for this is a knowledge of the machine characteristic curves, the operating material characteristic curves and preventive process knowledge instead of iterative process knowledge. The image data-oriented printing machine constitutes the precondition for the standardization of the print quality which has already been introduced at the pre-press stage and is now having an effect on the printing machine itself. That is to say a print quality which is determined by the color locus. In the image data-oriented printing machine, all the specialist fields (machine construction, electrical engineering, electronics, software, printing technology and so on) and system observations relating to the entire printing production and further-processing processes are included in a wide-ranging manner, in order to develop an innovative, competitive production environment for future printed products.

In an image data-oriented printing machine of this type, it is assumed that there is a short inking unit, such as the one disclosed, for example, by DE 197 31 003 A1. This short inking unit is reaction-free and is necessary in order to be able to perform stable profiling of a printing machine. The plate cylinder is inked by the short inking unit without using zones. According to an embodiment of the invention, the permissible quality corridor may be restricted. This means that a smaller offset between the colors, for example cyan, magenta, yellow and black, may be implemented in the color space. This also applies if printing is carried out using a larger number of different colors. The printing machine permits color management (to the ICC standard) to be continued even into the printing machine itself (i.e., a stable and reproducible machine technology profile can appropriately be achieved). Therefore, compensating the transfer characteristic curves by means of the imaging operation goes far beyond purely process-typical characteristic values (for example the offset process), which are used in a manner encompassing all types of printing machines. Instead, it is oriented towards characteristic values which are typical of printing points and which permit adaptation which is significantly improved and, above all, can be automated to the required color locus. The idea of the present invention is not specific to any process. The invention may be implemented both in wet and dry offset, in direct or indirect gravure printing, in the flexographic printing process, and so on.

A further advantage of the invention is that rejects on the printed material can be reduced as a result of the omission of control strips which otherwise have to be printed at the same time as each printed copy. Control elements are needed only during the basic calibration, which has to be carried out, for example, only at relatively long time intervals, for example only once per week.

Feed-forward color control on the basis of profound process know-how, in conjunction with simple, rapid ink density regulation, guarantees that the desired color loci are reached rapidly and accurately. Zone-less, quick-reaction inking systems are used. The operation of the machine is simplified as a result of the automation of the printing process. The know-how of the printer influences an expert system to begin with, and the latter makes method suggestions. For its operation, the printing machine only requires an operator instead of a trained printer. The knowledge of the printer is transferred into the pre-press stage. The printing machine has a sharply reduced number of possible mechanical intervention points. The possible intervention points which are dispensed with are looked after by the expert system. Furthermore, the printing process technology is also systematized. The expert system contains all the quality-relevant variables with the respective possibilities for influence and the mutual interlinking of variables. Systematization also provides, inter alia, the basis for remote maintenance, which, going beyond purely mechanical points of view, also makes it possible for the service engineer to assess the printing technology and, for example from a remote location, to make contact via the printer using a video telephone, or to control a robot using a video telephone.

In comparison with previous printing mechanism technology, the present invention also permits more cost-effective engineering to be implemented in that roll-cooling, regulating devices for the impression width, half-tone roll and so on are dispensed with. Instead, controlled-force roll setting means, extremely finely meterable doctors and so on are used.

The image data-controlled printing machine is particularly advantageously implemented as a direct imaging printing machine. The direct imaging printing machine forms the precondition for continuous image-data transmission and image-data modification. However, it is also possible for known plate setters to be used, but the transport of the printing plates, the setting up of the printing plates in correct register, and the time which elapses between imaging and printing are disadvantageous.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is explained in more detail below using an exemplary embodiment and with reference to the drawings, in which:

FIG. 8 is a table showing adjustment possibilities in the printing machine according to the invention.

DETAILED DESCRIPTION OF THE PRESENTLY PREFERRED EMBODIMENTS

Figure 1:
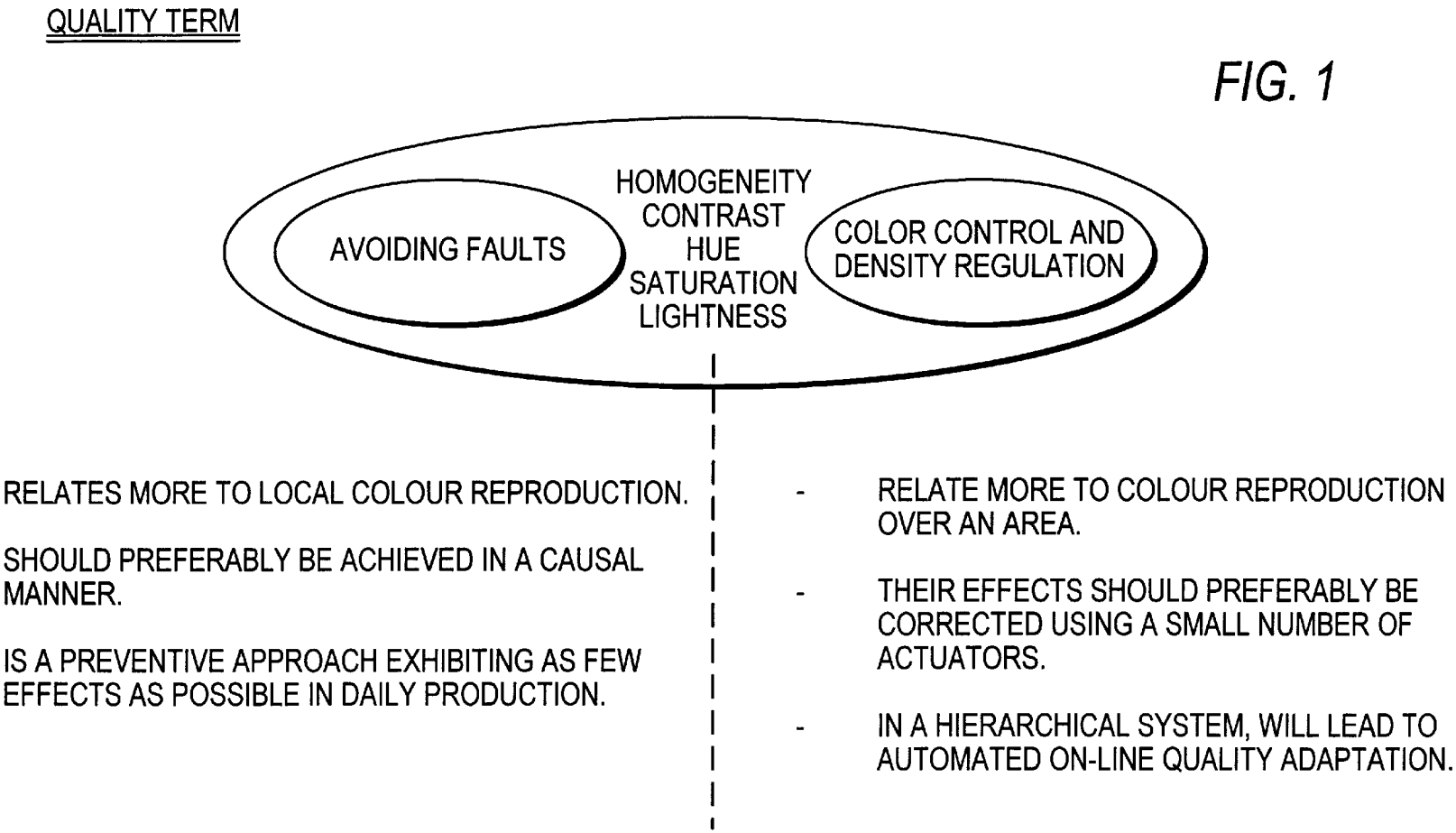
FIG. 1 is a diagrammatic representation of quality criteria.

For a printed image, it is possible to define a quality term (FIG. 1), which takes from the printed image those variables which are relevant to the observer of the printed image. Specifically the homogeneity of the image, the contrast, the color printing (hue), the saturation and the lightness of the image. In the sense of a quality strategy according to the invention, quality in the negative sense is defined as avoiding faults and in the positive sense as color control/density regulation.

In this case, avoiding faults relates more to the local color reproduction. Avoiding faults should preferably be achieved in a causal manner. It is a preventive approach exhibiting as few effects as possible in daily production. On the other hand, the terms "color control" and "density regulation" relate more to the color reproduction over an area. Their effects should preferably be corrected using a small number of actuators. In a hierarchical system, as will be explained later with reference to FIG. 6, color control and density regulation lead to automated on-line quality adaptation.

Figure 2:
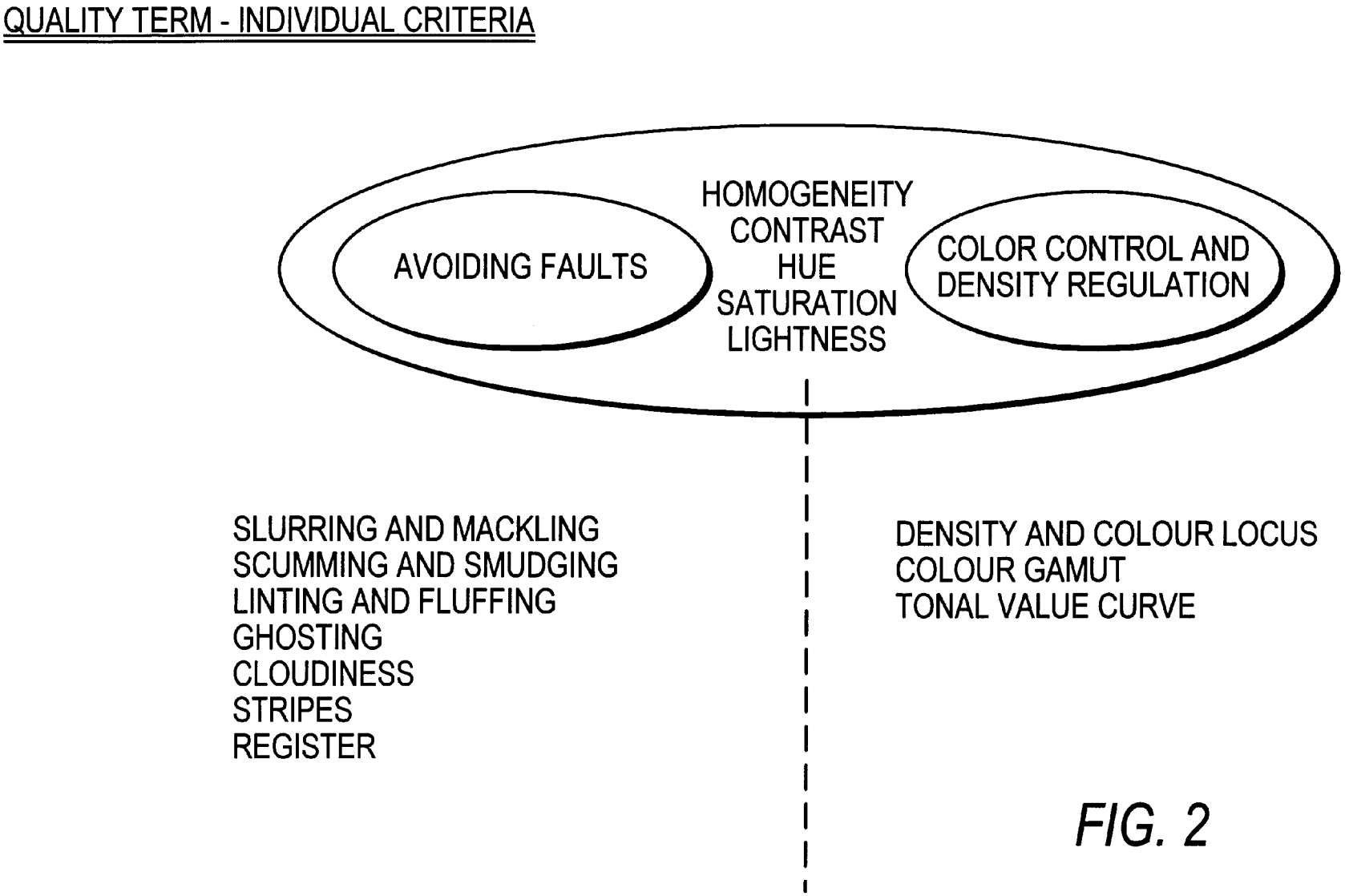
FIG. 2 is a diagrammatic representation of individual criteria for the general quality criteria shown in FIG. 1.

The term "avoiding faults" may be understood to include a large number of individual criteria (FIG. 2). The following may be listed, purely by way of example: slurring and mackling, scumming and smudging, Tinting and fluffing, ghosting, cloudiness, stripes, and register. On the other hand, color control and density regulation are aimed at the values to be assessed over an area, such as density and color locus, color gamut and tonal value curve.

Figure 3:
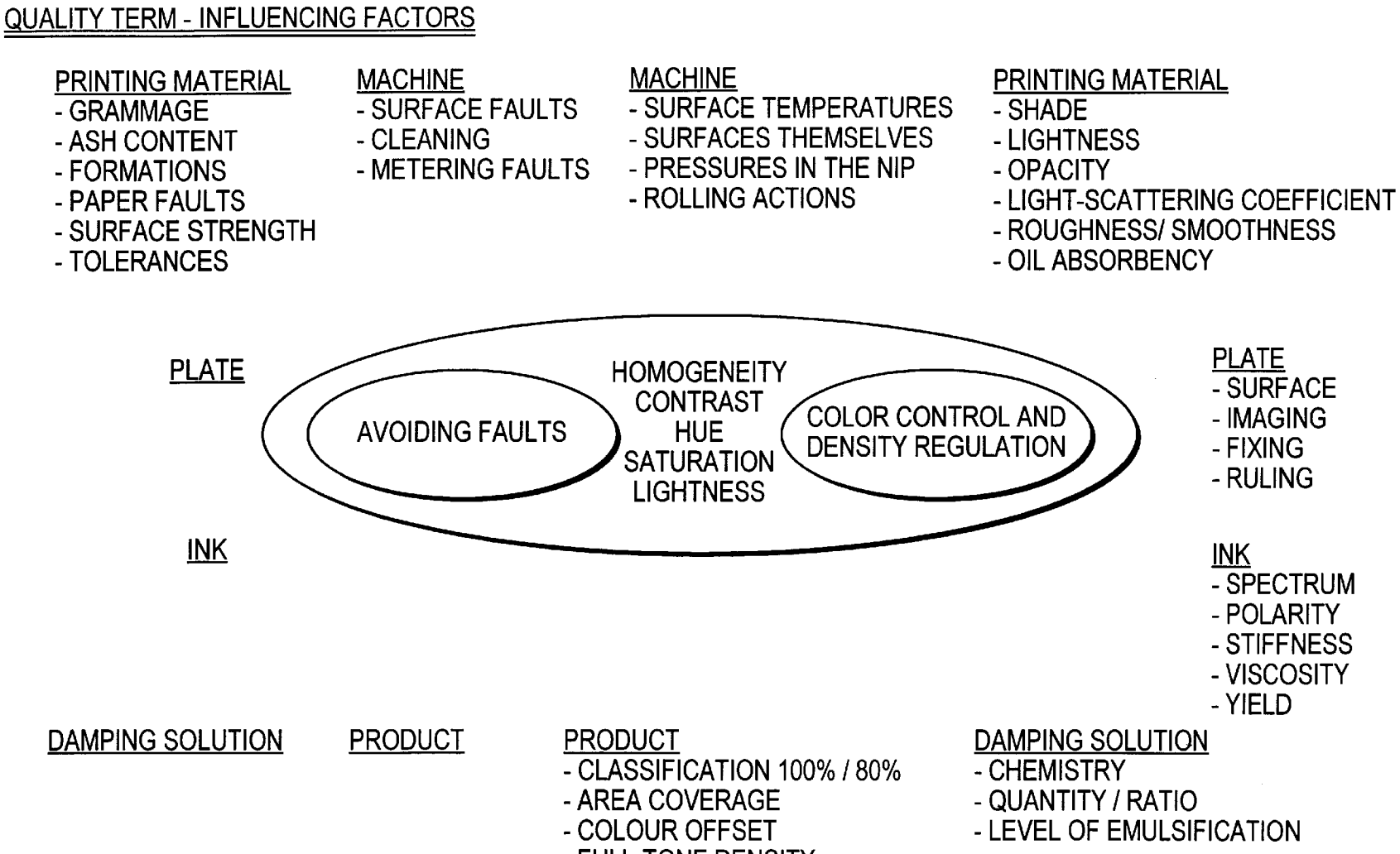
FIG. 3 is a diagrammatic representation of influencing factors for the general quality criteria shown in FIG. 1.

With regard to the definition of the quality term, it is possible to find a large number of influencing factors (FIG. 3) which have to be taken into account in avoiding faults and in both color control and density regulation.

With regard to avoiding faults, the following variables have to be taken into account: the printing machine may have point-like surface faults on its cylinders, and these may cause faults; likewise, inadequate cleaning leads to faults; and in metering faults of printing ink and damping solution may also occur. In the case of the printing material, the grammage, ash content, formation, paper faults, surface strength and tolerances in these variables have to be taken into account. Individual, point-like faults may occur in the printing plate, the printing ink, the damping solution and the printed product.

The color control and density regulation of the printing machine are generally influenced by the surface temperatures, by the chemical and physical condition of the surfaces themselves, by the pressures in the nip and the cylinder rolling actions (i.e., the mutual rolling of the cylinders on each other while achieving identical speeds at the surface of the cylinders in the contact or pressure zone). In the case of the printing material, the shade, the lightness, the opacity, the light-scattering coefficient, roughness or smoothness, and oil absorbency, etc. are decisive. In the case of the printing plate, the surface, the imaging, the fixing of the imaging and the ruling are relevant factors. The ink is distinguished with respect to the color spectrum, polarity, stiffness, viscosity and yield. For the damping solution, the chemical compositions, the quantity as related to the printing ink used, and the level of emulsification which is brought about by this in the printing ink are decisive.

The printed product which is produced while taking these factors into account may be classified in percentage values with regard to the area coverage, the color offset, the full-tone density and the half-tone.

The optical density which results on the printed product depends on a large number of influencing variables (FIG. 4), which are in turn correlated with one another. The damping solution content 10 results from the type of damping solution used 12, from the subject 14 (i.e., from the proportion of the area to be printed), from the rolling actions 16 between the cylinders and the type of printing material 18. The printing material 18 itself has a direct influence on the optical density 20. For its part, the damping solution content 10 influences the ink splitting 22 which, like the rolling actions 16, depends on the pressures in the nip 24 between the printing cylinders. Furthermore, the ink splitting 22 depends on the viscosity 26 of the printing ink used, and on the surfaces 28 of the rolls and cylinders in which it is conveyed. For their part, the pressures in the nips 24 between the cylinders depend on the surface temperature 30 of the cylinders. However, the surface temperature 30 also influences the printing ink, by changing its viscosity 26 and stiffness 32. The stiffness 32, which, like the viscosity 26, depends on the type of ink 34, also has a direct influence on the viscosity 26. The type of printing ink 34 has an influence on the yield 17, which for its part depends on the damping solution content 10. The yield 17 directly influences the optical density 20 and the viscosity 26. There is a further relationship between the viscosity 26 and the ink splitting 22, the viscosity influencing the ink splitting.

A further decisive quality criterion is the tonal value gain 54 (FIG. 5) in the halftone fields. The first influencing variable for the tonal value gain 54 is represented by the type of printing plate 50 and its imaging. The type of post-treatment following the imaging, for example the fixing of the printing image, is also decisive. If the printing plate is imaged by means of a thermal transfer process, for example, the material which is transferred from the thermal transfer tape to the printing plate is of importance. The base material of the printing plate is also decisive. During the printing operation, if an indirect printing process is used, the tonal value gain 54 is also influenced by the rubber blanket 56 of the transfer cylinder; in practical terms, the contact pressure between the blanket and the printing plate and the printing material are influencing variables, as is the material of the rubber blanket. The rubber blanket 56 and surface temperature 30 have an influence on the pressures 24 which are established in the nip between the plate cylinder and the transfer cylinder. The type of printing ink 34 used influences the tonal value gain 54 directly via the viscosity 26 and indirectly via the ink layer thickness 58, which is also influenced by the viscosity 26. The damping solution content 10, which depends on the type of damping solution 12 and the subject 52 (i.e., the proportion of the area to be printed) likewise influences the viscosity 26. The subject 52 itself also influences the tonal value gain 54 directly. The type of printing material 18 directly influences both the damping solution content 10 and the tonal value gain 54.

Figure 4:
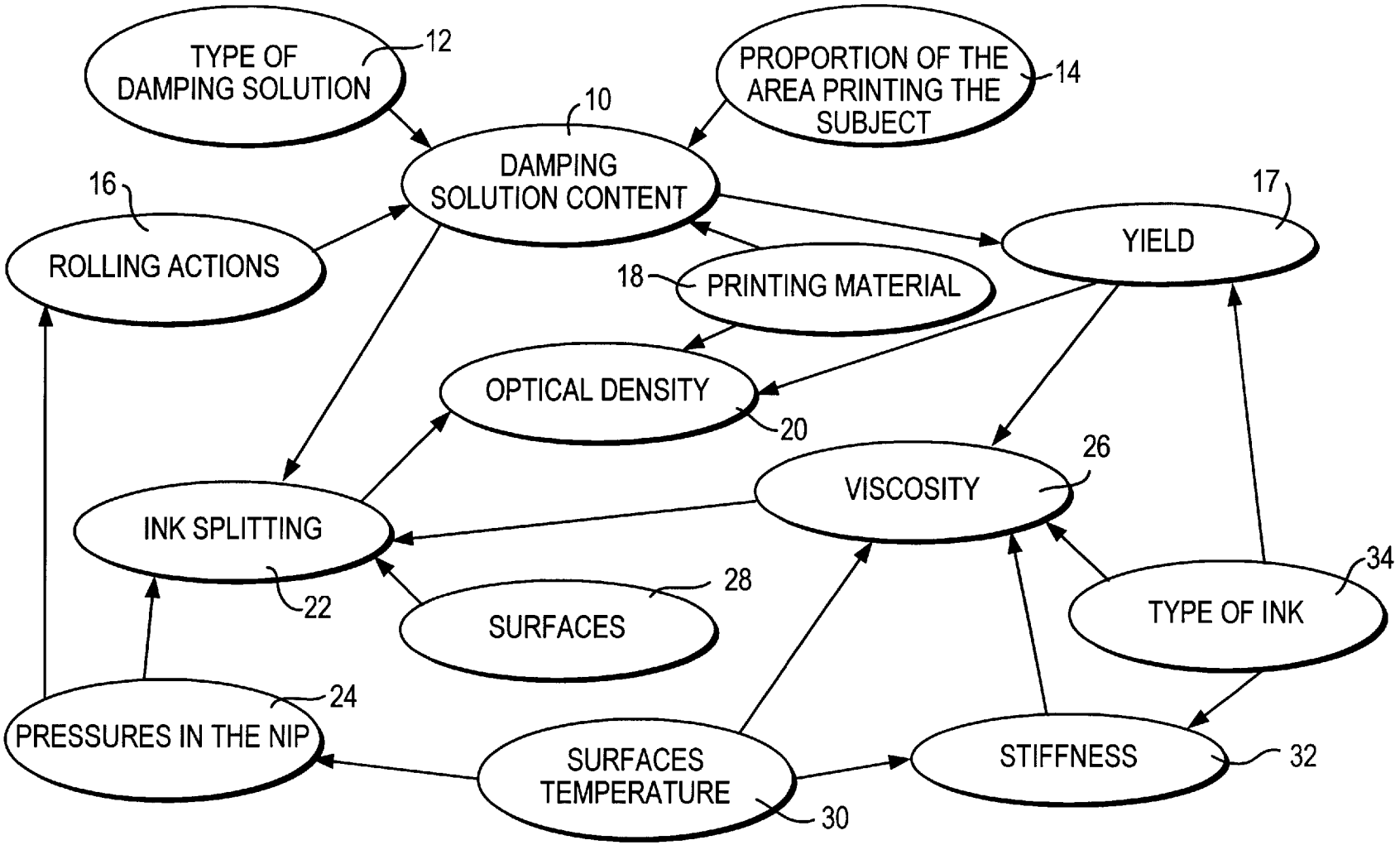
FIG. 4 is a diagrammatic representation of the relationship between influencing variables and the optical density according to the invention.
Figure 5:
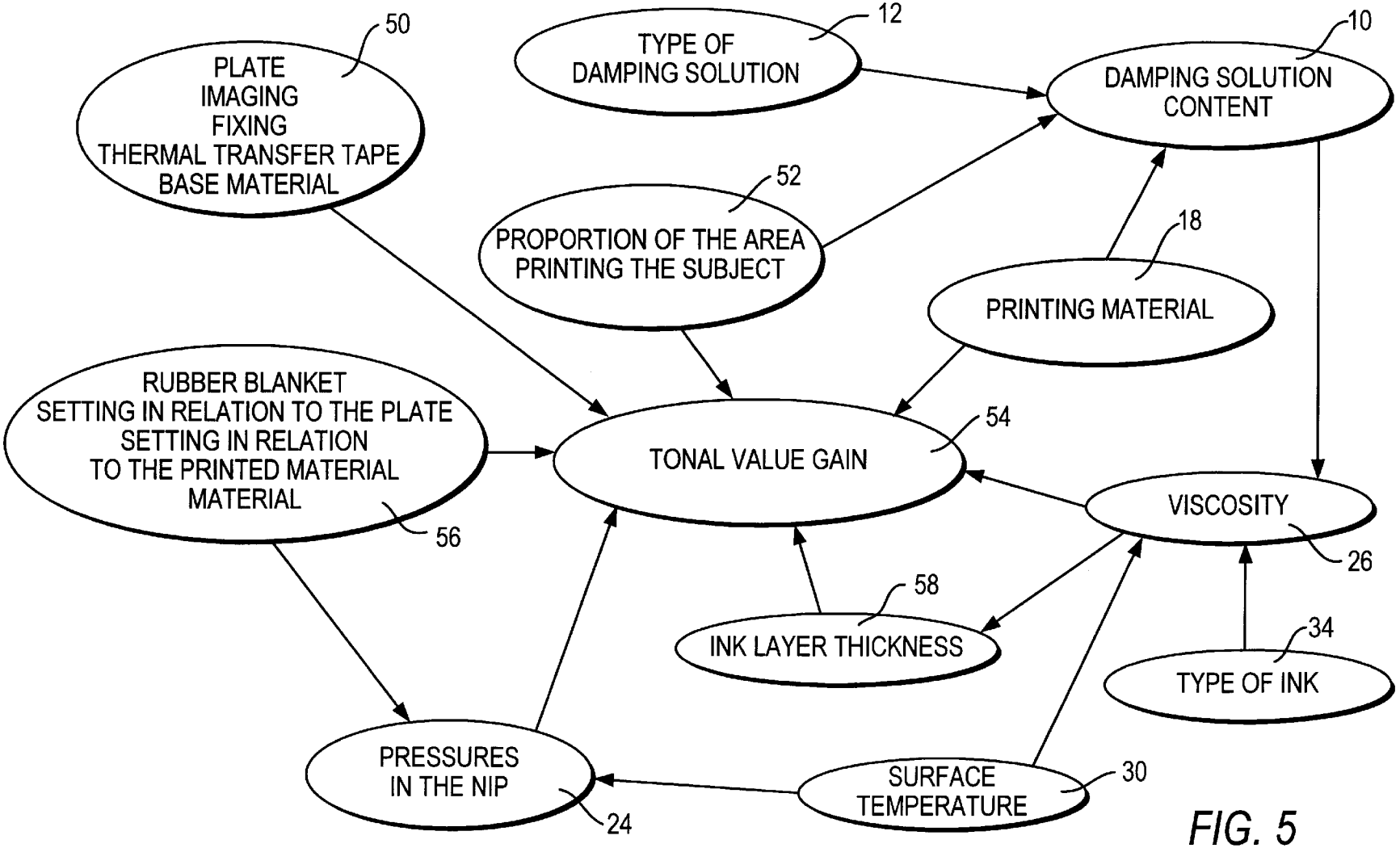
FIG. 5 is a diagrammatic representation of the relationship between influencing variables and the tonal value gain according to the invention.

After the quality criteria, influencing factors and weights (FIGS. 1 to 3) have been defined, the illustration in FIGS. 4 and 5 create the understanding of the effect mechanisms between the various influencing factors. This understanding provides the precondition for a quality regulation system which can be automated.

The general quality features, such as homogeneity, contrast, hue, saturation and lightness (FIG. 1, FIG. 2) may be subjected to a method of quality adaptation and, in the course 5 of the quality adaptation, are improved and adapted more and more by active control or active regulation of the color reproduction and by avoiding faults.

Figure 6:
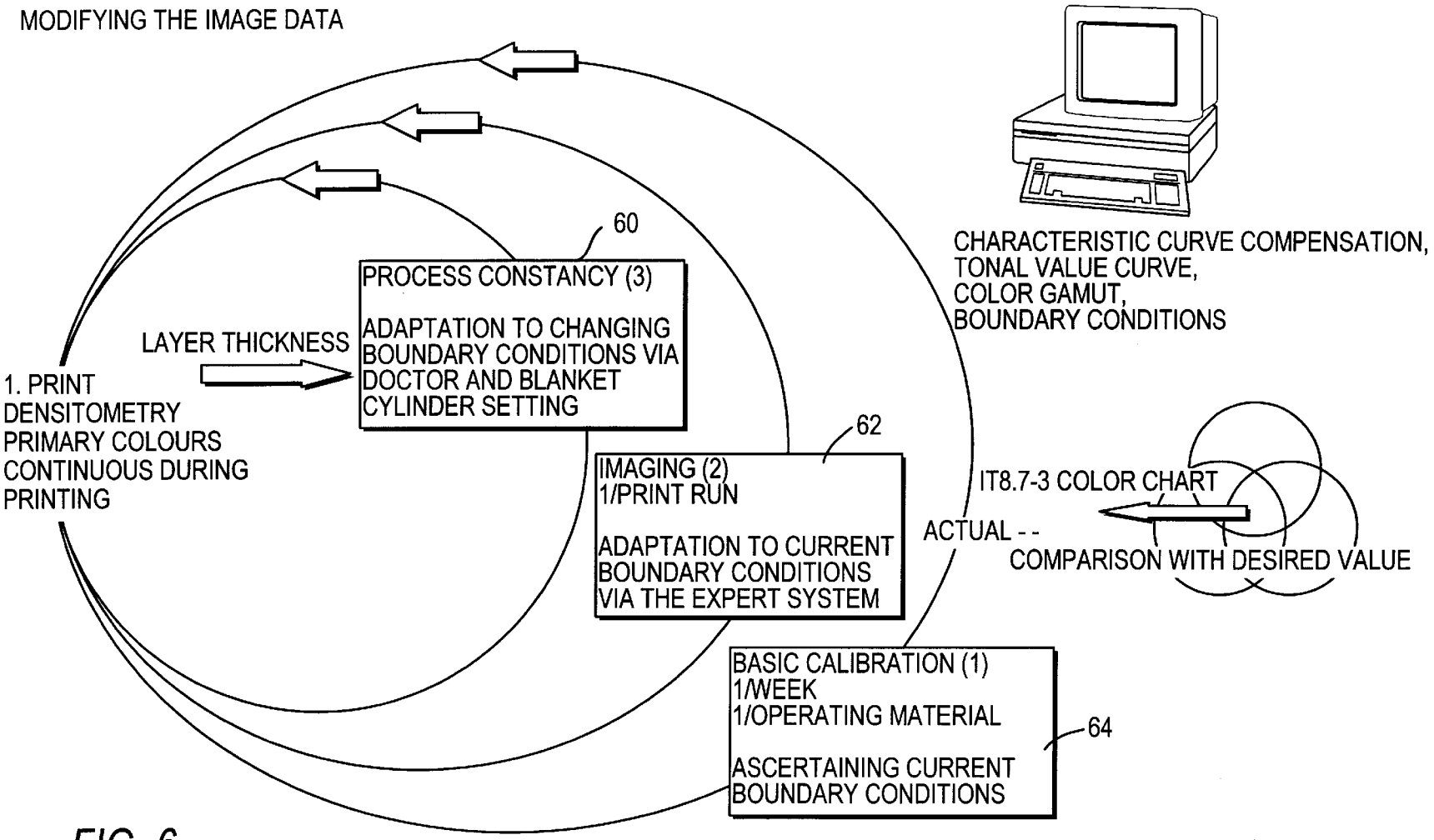
FIG. 6 is a schematic diagram relating to modifying the image data in accordance with the present invention.
Figure 6A:
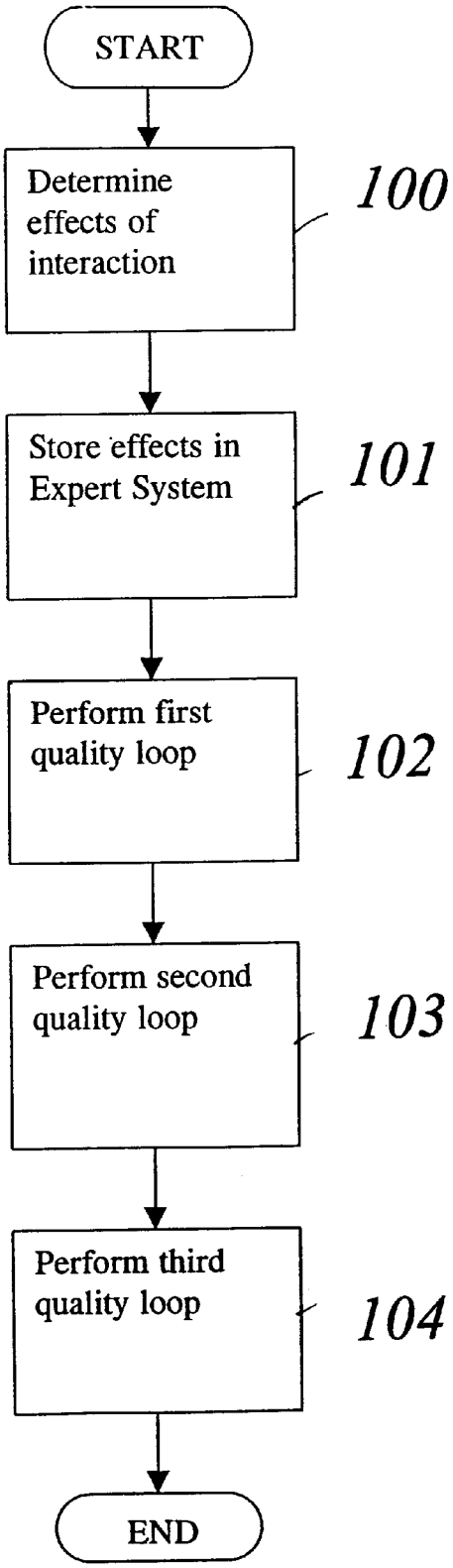
FIG. 6A is a flow diagram for the method of operating a printing machine having an expert system according to the present invention.

Color reproduction is subdivided into three quality loops (steps 102, 103, and 104 in FIG. 6A), which are carried out before printing, during printing or after printing (FIGS. 6 and 6A). Within the context of general printing process technology, firstly basic knowledge about the interaction between different operating media (printing ink, damping solution (in wet offset printing), printing material, machine surface, printing machine), is gathered during extended printing trials step 100 in FIG. 6A. The values gathered are then stored in an expert system, step 101 in FIG. 6A. and the storage of the values in an The expert system is ideally a self-teaching system, which comprises fuzzy logic, a neural network, PID and mixtures of these three functional approaches, as required, and which is capable of interpolation in relation to the production sequences over a sufficiently large number of reference points in n-dimensional space. The expert system is preferably also capable of describing the influence of an individual parameter, such as the optical density as a function of the viscosity (FIG. 4), in terms of its weight in the overall system. The expert system is therefore able to indicate the percentage to which a change in the viscosity changes the optical density of the printed image, and to what extent this change changes the printed image as a whole.

At specific, relatively long time intervals, the operator carries out a basic calibration 64, which constitutes a desired/actual comparison based on mechanical and electrical characteristic values, for example position feedback relating to cylinder contact positions or to doctor positions etc., step 102 in FIG. 6A. This calibration serves for the regular zeroing of the printing system within the printing machine. From the basic calibration, within the context of a preventive maintenance system, the time for changing specific machine components, for example a doctor or a rubber blanket, may be derived. The time for the basic calibration itself is preferably at the end of a production unit, for example at the end of the week, so that maintenance during down times is possible. The basic calibration permits a characteristic curve which depends on the operating width and the operating scope of the printing machine to be ascertained, with it being possible for this characteristic curve to be compensated via the image data, if necessary. A characteristic curve based on the printing characteristic values serves to confirm the preceding mechanical and electrical zeroing in terms of its effect on the print. It contains the profiling, that is to say the transfer characteristic curve of the image data to the printing material at the individual printing point. For this purpose, densitometric data, such as the interaction of all the printing points, or spectrometric data are used with reference to a test form, for example with reference to an IT8.7-3 color chart. This profiling supplies knowledge about both the printing machine given a known operating material combination, and the expansion of the expert system in relation to a new operating material combination, given otherwise known printing machine technology. In this case, it is also possible for a roll surface, for example that of a damping-solution or ink applicator roll, to be defined as an operating material. This profiling, performed at a specific time, yields the achievable, instantaneous color gamut and tonal value curves and, from these, the current compensation requirement of the image data.

In a second quality loop 62, the imaging operation is adapted, step 103 in FIG. 6A. In this case, the areas and half-tones to be imaged for each color separation or for each printing point, in the colors cyan, magenta, yellow and black, are adapted to the respective boundary conditions (for example printed product, printing ink and printing material) and the current machine conditions (for example temperatures, pressures, relative humidity of the air), based on the principles of printing process technology, in the same way as during the basic calibration. From the characteristic curve compensation and once more adapted to current boundary conditions, a desired density value results for each individual printing point whose combination with the other printing points ensures the ideal color value. The color value is controlled via the ink density of the individual inks. If the compensation requirement deviates by more than a specific threshold value, although production can be operated further from this increased compensation requirement, a warning is issued at the operating desk or on a fault-report printer. Likewise, the expert system is capable of taking into account faults which occur when printing plates which have been imaged outside the printing machine are clamped on the plate cylinder. If register faults occur during the imaging of printing plates within the printing machine, this is also taken into account by the expert system.

In a third quality loop 60, the aim is process constancy by means of ink density regulation, step 104 in FIG. 6A. Since not all the boundary conditions are constant over the printing time—there should also be the possibility of a long print run—the above-described control of the color value is supplemented in the third step by ink density regulation. The constancy of quality is regulated by regulating the effects of ink density and tonal value on the minimum number of necessary actuators. Control processes are therefore not carried out on all the individual causes involved, such as temperature, level of emulsification, impression widths and so on, at respectively associated actuators (temperature regulation, damping solution regulation, impression width regulation). A densitometer makes measurements in the printed image continuously or at specific uniform time intervals, relating to a circumferential value or individual values which are triggered by a rotary encoder on the plate cylinder. The axial position of the measuring head is likewise determined from image contents or image data where the measuring position may be ascertained on the basis of different procedures. The image contents may be broken down in accordance with a generic method, in which, for example, information from a customer about the product XY to be promoted by means of a specific printed image to be reproduced in a particularly true-to-life manner or in a quite specific way, as already known from EP 0 639 456 B1. Likewise, the measuring position may be selected in accordance with specific area coverage values, for example 40%, 80% or 100%, for the respective color separation, or regular individual values are used successively. Depending on the position of the image and the job, it may be necessary to position one, two or more densitometers over the width of the printed image.

Figure 7:
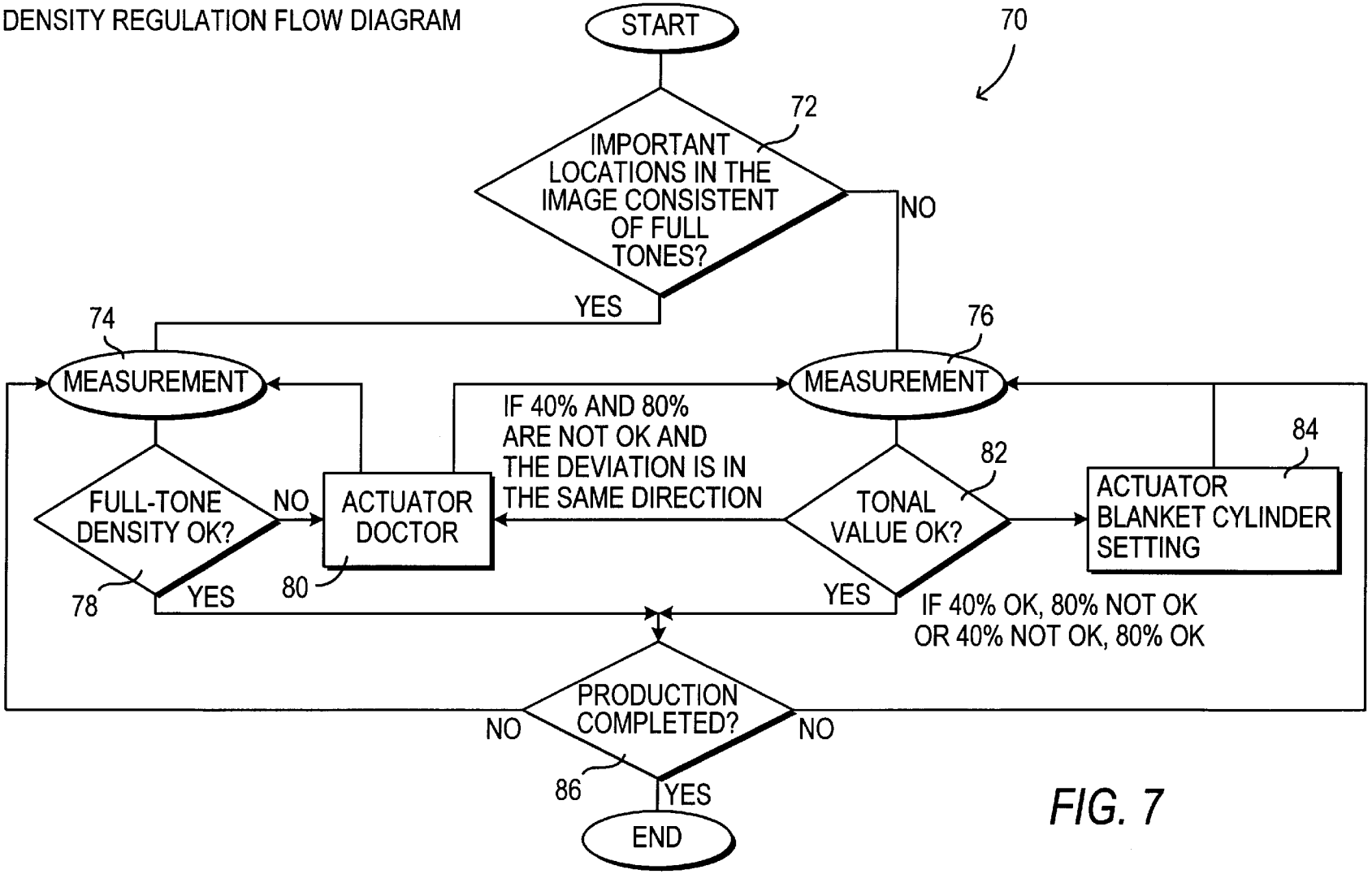
FIG. 7 is a flow diagram for density regulation according to an embodiment of the present invention.

In principle, there are two different control strategies in the density regulation flow (FIG. 7), which depend on the image contents. The main emphasis of an image is either in the full tone or the half tone. If both types of impression are present, a priority must be set, corresponding to the customer's request. FIG. 7 shows a flow diagram of the density flow regulation 70 according to the invention. Depending on whether the important locations in the image consist of full tones 72, the densitometric measurement (steps 74 or 76) is carried out in full-tone areas. When the important locations in the image do consist of full tones, the measurement of the full tone areas (step 74) is performed. If the full-tone density measurment is not viewed as adequate (step 78), the position of a doctor 2 resting on an ink applicator roll 1 (FIG. 9) may be adjusted by means of an actuator 3 (step 80). The ink applicator roll 1 inks a plate cylinder 4 which, in the case of an indirect printing process, provides a printing material 6 with an image via a transfer cylinder 5. In the preferred embodiment, the transfer cylinder 5 comprises a blanket cylinder 5 and will be referred to as a blanket cylinder hereafter. When the full-tone density is determined to be adequate (step 78), the production is completed (step 86).

For the other case, in which the important locations in the image do not consist of full tones but of half tones (step 72), the measurement of the half-tones in the full tone areas is performed (step 76). If the half tones deviate from the desired value in the same direction in the case of a 40% and an 80% area coverage (step 82), the doctor 2 is likewise adjusted by the actuator 3 (step 80). However, if the tonal densities at 40% and 80% deviate from the desired values in different directions, the contact pressure between the blanket cylinder 5 and the plate cylinder 4 is changed (step 84). The measurements on full-tone densities or half-tone densities are carried out right up to the end of production. In the "density regulation" flow diagram (FIG. 7), the only actuators for the ink supply are thus the doctor 2 and the contact pressure of the blanket cylinder 1. In the case of offset printing, the doctor 2 is an extremely finely adjustable doctor, for example the roller doctor illustrated in FIG. 9, and for gravure printing, for example, a chamber-type doctor. The transfer of the half-tone dots from the printing plate to the printing material 6 is regulated by means of the blanket cylinder 5, which can be moved precisely.

Figure 9:
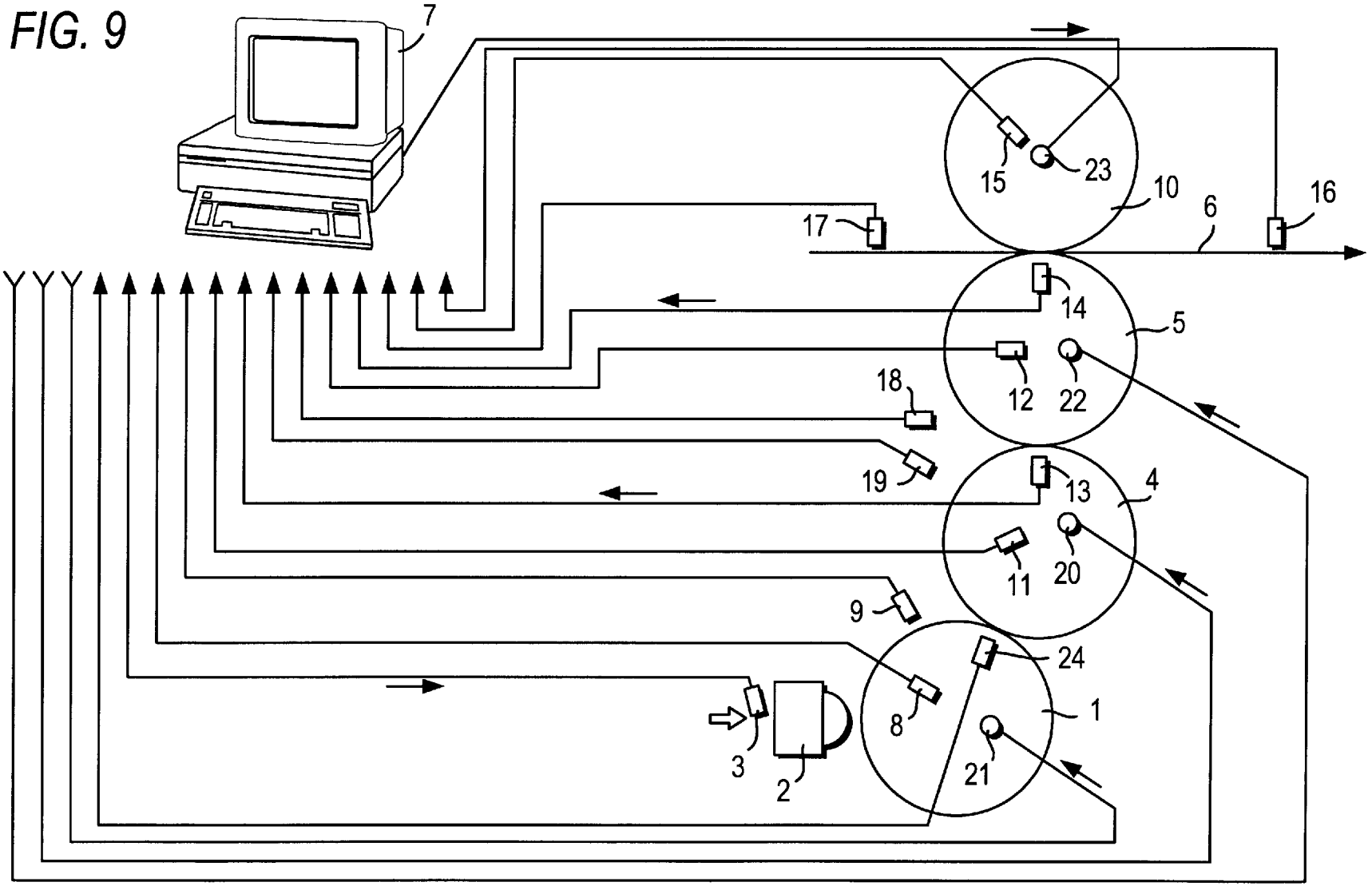
FIG. 9 is a schematic diagram of the structure of the printing unit according to an embodiment of the invention.

Referring to FIG. 9, the expert system is stored in a computer 7, for example a control-desk computer or another computer connected to the printing machine, and is available for the control and regulation of the printing machine. The expert system is connected to the actuator 3 which is controlled by computer 7 to adjust the doctor 2 by means of a force. The doctor may be displaced parallel to the longitudinal axis of the ink applicator roll 1, so that the result is an identical distance between the doctor 2 and the outer surface of the ink applicator roll 1 over the width of the cylinder. The computer 7 sets this position of the doctor 2 during the basic calibration, so that a static setting is always present as a basis for further adjustments. However, the expert system can make available subject-related settings for various imaging jobs, these also being static settings. Likewise, computer 7 can also perform low-frequency to high-frequency changes to the setting of the doctor 2 in relation to the ink applicator roll 1. The setting of the doctor 2 can also be made dependent on the rotational speed of the ink applicator roll 1. For this purpose, computer 7 is connected to a speed sensor 8, which, for example, is a rotary encoder and feeds back the rotational speed of the ink applicator roll 1 to the computer 7. Further sensors, such as a sensor 9, are preferably also arranged on the ink applicator roll 1, in order to determine, for example, the temperature on the outer surface of the ink applicator roll 1 or the layer thickness of the printing ink picked up by it. Corresponding sensors 19 and 18 are assigned to the plate cylinder 4 and the transfer cylinder 5, respectively. The surface material of the ink applicator roll 1, and also that of the plate cylinder 4, the transfer cylinder 5 or the impression cylinder 10, are entered into the computer 7 before the beginning of the printing process or before the beginning of a production unit and, by means of the expert system, computer 7 takes into account these surface properties (e.g., the temperatures) when setting specific operating parameters. Exactly the same sensors 11 and 12 are arranged on the plate cylinder 4 and the transfer cylinder 5, respectively, for the purpose of determining the rotational speeds of the plate cylinder 4 and of the transfer cylinder 5, and the functioning of these sensors corresponds to that of the sensor 8 for the ink applicator roll 1.

An actuator 13 determines the contact pressure between the plate cylinder 4 and the transfer cylinder 5, and is additionally equipped with a sensor which feeds back the respective contact pressure to computer 7. The contact pressure between the plate cylinder 4 and the ink applicator roll 1 may also be changed by means of an actuator 24 which includes a sensor which relays the set pressure to computer 7. Likewise, the contact pressure between the transfer cylinder 5 and the impression cylinder 10 may be changed by means of an actuator 14, which is likewise equipped with a sensor in order to relay the set value to the computer 7. The rotational speed of the impression cylinder 10 is ascertained by means of a sensor 15 and relayed to computer 7. A sensor 16 determines the optical density of the printed material 6. A further sensor 17 determines other properties of the printing material, for example its surface roughness, in order to ascertain more closely the type of printing material 6. A sensor corresponding to the optical sensor 16 may be provided on the other side of the printing material 6 in order to ascertain the change in the optical density as a result of the printing ink applied, and to report this to computer 7. For the case in which the plate cylinder 4, the ink applicator roll 1, the transfer cylinder 5 and the impression cylinder 10 each have their own drive, these are assigned actuating means 20–23, in order to adjust the rotational speed. The actuating means 20–23 are each controlled by the expert system, and are connected to computer 7 via the control lines. If the expert system outputs appropriate signals respective to the actuating means 20–23, the contact pressures between the applicator roll 1 and the plate cylinder 4, between the plate cylinder 4 and the transfer cylinder 5, and between the transfer cylinder 5 and the impression cylinder 10, can be changed both before the beginning of the printing process or during the printing process, for example, to compensate for faults which are inherent to the printing machine.

It is also possible to position the doctor 2 obliquely over the entire width of the ink applicator roll 1 (i.e., the whole width of the plate cylinder 4). During the imaging operation, this may prove to be expedient when a fault which develops linearly over the width of the ink applicator roll 1 is produced. This is also true in the case of low-frequency to high-frequency changes which have an effect over the width of the ink applicator roll 1; these can be counteracted by means of the doctor 2.

Faults which extend over the width of the plate cylinder 4 and thus over the entire width of the ink applicator roll 1, but can be represented only as a non-linear fault function, may be taken into account only statically by means of compensation during the imaging operation.

Changes which arise over the circumference of the plate cylinder 4 and, as a result of this, also over the circumference of the ink applicator roll 1 may be taken into account statically during the imaging operation and may be dynamically compensated for by the expert system by means of a low-frequency to high-frequency adaptation of the distance between the doctor 2 and the outer surface of the ink applicator roll 1 during the printing process. In the case of faults which occur as a function of the subject or only locally, compensation may be achieved only by the imaging operation. In the case of the dynamic compensations which are permitted by the doctor setting or the blanket cylinder setting, the frequency of the movement of the doctor 2 or of the blanket cylinder S may correspond directly to the frequency of the plate cylinder 4 if the faults which are to be compensated for are caused precisely by the plate cylinder 4. However, the frequency of setting the doctor 2 or the blanket cylinder 5 to and fro may also be quite different if a number of components of the printing machine, for example a number of rolls in the inking or damping unit, possibly in conjunction with printing cylinders, produce a number of faults which are added to one another. These are, for example, circulatory faults or ghosting. The fact that the expert system is capable of learning means that all these faults can also be taken into account during production, so that they may be compensated for and eliminated appropriately by adjusting the doctor 2 or the blanket cylinder 5.

In the sense of the present invention, avoiding faults in the system of a printing machine thus has a very preventive character (cf. FIG. 1), which is opposed to the usual procedure according to the prior art, in which faults only become evident in the printed copy. The system of avoiding faults according to the invention is implemented in three loops in a hierarchical system, in parallel with the color control and the ink density regulation, with the intention that the printing production itself should run without faults and with few rejects. In a first quality loop, the objective in the basic concept is to avoid the maximum number of faults at the source, by reducing the complexity of the printing machine. This purpose is served, for example, by using a reaction-free inking unit, such as the one proposed, for example, in DE 197 31 003 A1. A reaction-free inking unit of this type allows ghosting to be eliminated. A well-coordinated operating material combination also serves to avoid faults, ensuring the fault-free daily reproducibility of the printing results by way of the specification of the relevant variables. Likewise, regular, automatic cleaning cycles, which prevent Tinting and fluffing, contribute to avoiding faults. The implementation of this requirement is not a problem, because of more frequent cleaning cycles, in the case of short run color jobs. Register faults are also reduced by in-register machine technology (CIC=common impression cylinder), that is to say a printing machine equipped with a satellite cylinder as an impression cylinder, or standard, automatic imaging within the printing machine, if there is no in-register machine technology.

In a second quality loop, faults are already detected and eliminated in the sense of preventive correction during the weekly basic calibration. This applies, for example, to slurring caused by the rubber blanket.

In a third quality loop, the compensation requirement of the current imaging operation is evaluated in a statistics module which is part of the expert system, and delivers faults which occur over time and whose correction is recommended.

During the printing production itself, no faults are expected. Nevertheless, an evaluation of the gradients or ink density values over time is carried out, with a recommendation for the further procedural method.

It thus transpires that the present invention, with regard to data orientation in already known printing machines with in-line or off-line imaging, starts with conventional printing machines which already have further quality-controlling elements such as ink density control systems or register control systems. In current conventional printing machines, it is accordingly possible for printing plates to be influenced in accordance with specific process characteristic curves, for example enlarging half-tone dots in the offset printing process. However, this only permits the adaptation of a quite general process characteristic curve. This is the starting point for the invention, which, by means of the expert system, influences the printing process technology at specific time intervals and in specific control loops, which provides fully automatic color-locus control and ink-density regulation. In a corresponding way, the printing machine technology (for example gravure printing inking or reaction-free, zone-less offset short inking unit, flexographic printing machine and so on) is adapted and appropriately specified operating materials are also selected.

As a result of the accurate, up-to-date knowledge of the machine, process and operating-material characteristic curves, exact and up-to-date quality adaptation at each individual printing point is possible before printing, during printing, or following printing. In a further specification stage, according to the basic idea of the invention, nothing is changed in terms of the components of the machine construction, while the value of the printing machine is increased by software. Software has the advantage that it can be introduced with a much lower outlay than hardware changes on the printing machine, so that the profit which may be obtained with the printing machine is increased by the invention via software expansion stages on the printing machine. Furthermore, the invention provides fault diagnosis and remote maintenance which make fault compensation possible without operating personnel having to intervene on site. Customer requests in the sense of "generic coding" are taken into account. Printing machine technology is supported by additional software, which increases the economic efficiency, the availability and the claim to quality of the printing machine.

The invention provides a method of operating a printing machine in which basic knowledge about the interaction between operating media in the printing machine is obtained by means of printing trials or during production. This knowledge is stored in an expert system and made available for the printing operation or else for the production of the printing plate. The expert system is preferably a self-teaching system. For color reproduction, basic calibrations are carried out in a first quality step, in a second step, the imaging operation is adapted to the areas and half tones to be imaged, and ink-density regulation is carried out in a third step.

The invention is not limited by the embodiments described above which are presented as examples only but can be modified in various ways within the scope of protection defined by the appended patent claims.

I claim:

1. A method of operating a printing machine having an expert system, comprising the steps of:

(a) determining the effects of the interaction between operating parameters of the printing machine via at least one printing trial and during production, the different operating parameters comprising printing machine parameters, printing material parameters, printing plate parameters, printing ink parameters, damping solution parameters and printed product parameters; and (b) storing the effects of the interaction in the expert system for use with a printing operation;

(c) performing first, second, and third quality loops, wherein the first quality loop comprises performing a basic calibration including determining the current operating parameters and determining a characteristic curve of control parameters to be used based on the current operating parameters, the second quality loop comprises printing an image and comparing a desired value and an actual value of the printed image, wherein the desired value is based on the characteristic curve in the expert system determined in the first quality loop, and compensating the characteristic curve based on a deviation of the actual value from the desired value, and the third quality loop comprises regulating a constancy of quality by regulating an ink density during print production.

2. The method set forth in claim 1, wherein step (a) further comprises the step of describing by the expert system a percentage to which a change in viscosity changes the control parameters in terms of weight in an overall system.

3. The method set forth in claim 1, wherein said step of performing a basic calibration is performed at predetermined intervals.

4. The method set forth in claim 1, further comprising the step of performing by the expert system preventative maintenance for deriving component replacement information for one of a doctor and a rubber blanket of the printing machine.

5. The method set forth in claim 1, said step (b) further comprising the step of producing by the expert system a densitometric profile of each individual printing point of image data to a printing material and thereby producing a transfer characteristic curve.

6. The method set forth in claim 1, said step (b) further comprising the step of conducting a spectrometric measurement with reference to a test form.

7. The method set forth in claim 1, said step (b) further comprising the step of determining by the expert system an achievable color gamut and tonal value curve, and using this information to determine a current compensation requirement of the image data.

8. The method set forth in claim 1, wherein in said step (c), the printing machine parameters are predefined by temperatures in the components of the printing machine, and pressure and relative humidity of the air.

9. The method set forth in claim 8, further comprising the step of providing a warning to at least one of an operating desk and fault report printer when a compensation requirement deviates from a threshold value by a predetermined amount.

10. The method set forth in claim 9, further comprising the step of evaluating individual values by a rotary encoder fitted to a plate cylinder of the printing machine.

11. The method set forth in claim 9, wherein said substep of regulating an ink density in said step (c) further comprises continuously measuring by a densitometer a circumferential scan in the printed image.

12. The method set forth in claim 11, wherein said substep of regulating an ink density in said step (c) comprises taking into account an axial position of a measuring head.

13. The method set forth in claim 11, wherein said substep of regulating an ink density in said step (c) further comprises using specific parameters of the images, said parameters of the images being stored in the expert system.

14. The method set forth in claim 11, further comprising the step of using specific parameters of the images during said step of regulating an ink density, said parameters of the images being currently predefined for the print job, and on the basis of a customer request.

15. The method set forth in claim 11, further comprising the step of using predefined area coverage values with specific tonal values in said step of regulating an ink density, said specific tonal values comprising one selected from a group consisting of 40%, 80% and 100%.

16. The method set forth in claim 11, wherein said step of regulating an ink density further comprises periodically measuring the density of a specific position of the image.

17. The method set forth in claim 11, further comprising the determining whether important locations in the image contain full tones or half tones;

adjusting a doctor of the printing machine via an actuator when full tones have been determined and there is a deviation from a desired full-tone density; and adjusting the doctor via an actuator when half ton es have been determined and an are a coverage deviates in the same direction, given two different half-tone values; and using the contact pressure between the blanket cylinder and the plate cylinder as the actuator when the tonal values deviate from the desired values in different directions given the same half-tone values.

18. The method set forth in claim 17, further comprising the step of operating the printing machine with coordinated operating materials to ensure fault-free daily reproducibility of the printing results.

19. The method set forth in claim 18, further comprising the step of providing an automatic standard register control system for setting the printing machine to output a true register.

20. The method set forth in claim 19, further comprising the step of evaluating by the expert system compensation requirement of faults which are recommended to be corrected during the imaging operation using a statistics module.

21. A printing machine comprising:

a reaction-free short inking unit;

an expert system for storing information relating to interactions between operating media of the printing machine obtained during printing trials and production for use during printing machine operation, said expert system having characteristic curves for electrical and mechanical printing parameters of the printing machine, wherein said expert system comprises a self-learning system capable of interpolating production sequences over a large number of reference points in n-dimensional space, said self-learning system comprising a combination of at least two from a group consisting of a fuzzy logic system, a neural network, and a PID;

means for performing a basic calibration by comparing desired values and actual values of at least one of the electrical and mechanical printing parameters, wherein the desired values are based on the characteristic curves in the expert system;

means for determining a density value for each printing point of a printed image by adapting the area and half-tones to be imaged for each printing point to actual boundary conditions and current printing machine conditions;

means for regulating a constancy of quality by regulating an ink density of the inking unit;

a plate cylinder in operable communication with said ink applicator roll;

a blanket cylinder in contact with said plate cylinder and having; and an actuator for varying a contact pressure between said blanket cylinder and said plate cylinder.

22. The printing machine in accordance with claim 21, further comprising a controlled-force setting device.

23. The printing machine in accordance with claim 21, further comprising:

a doctor in proximity to an ink applicator roll and being capable of being brought into contact with the ink applicator roll; and an actuator for selectively enabling said doctor to be brought into contact with the ink applicator roll.

24. The printing machine in accordance with claim 21, further comprising:

a plurality of sensors disposed within the printing machine for measuring operating variables of the printing machine;

a plurality of actuators for setting and changing operating parameters of the printing machine; and a computer connected to each of the plurality of sensors and actuators for enabling said actuators to set and change the operating parameters in response to the measured operating variables.

* * * * *